US007647717B2

(12) United States Patent
Chen et al.

(10) Patent No.: US 7,647,717 B2
(45) Date of Patent: Jan. 19, 2010

(54) NUMERICAL DISPLAY DEVICE

(75) Inventors: Haikun Chen, Shandong (CN); Liqun Zhang, Shandong (CN); Yanjun Wu, Shandong (CN); Bingtong Du, Shandong (CN)

(73) Assignee: Qingdao Autodisplay Co., Ltd., Qingdao, Shandong (CN)

( * ) Notice: Subject to any disclaimer, the term of this patent is extended or adjusted under 35 U.S.C. 154(b) by 211 days.

(21) Appl. No.: 11/823,449

(22) Filed: Jun. 26, 2007

(65) Prior Publication Data

US 2008/0024317 A1 Jan. 31, 2008

(30) Foreign Application Priority Data

Jul. 28, 2006 (CN) ..... 2006 2 0129222

(51) Int. Cl.
*G09F 3/04* (2006.01)

(52) U.S. Cl. ..... 40/450; 40/600

(58) Field of Classification Search ..... 40/450, 40/486, 492, 600, 588

See application file for complete search history.

(56) References Cited

U.S. PATENT DOCUMENTS 3,673,718 A * 7/1972 Bernard ..... 40/5
4,164,824 A * 8/1979 Nidelkoff ..... 40/450
4,507,888 A * 4/1985 Robinson et al. ..... 40/621
4,539,768 A * 9/1985 Halliday ..... 40/447
4,542,603 A * 9/1985 Streeter et al. ..... 40/447
4,583,312 A * 4/1986 King et al. ..... 40/621
4,729,184 A * 3/1988 Cihanek ..... 40/450
5,680,719 A * 10/1997 Poser ..... 40/450
6,643,965 B2 * 11/2003 Toraby-Payhan ..... 40/600
2003/0000120 A1 * 1/2003 McNamara ..... 40/450

* cited by examiner

*Primary Examiner*—Gary C Hoge
(74) *Attorney, Agent, or Firm*—Raymond Y. Chan; David and Raymond Patent Firm

(57) ABSTRACT

A numerical display device includes a base panel, a plurality of numerical sections provided on the base panel to form a numerical character, a plurality of folding panels pivotally coupling at the base panel to fold between a first position and a second position to selectively change the numerical character, and a magnet arrangement for retaining each of the folding panels at the first and second positions, wherein at the first position, the folding panel is pivotally folded on the base panel to fully cover the respective numerical section, and at the second position, the folding panel is pivotally folded at 180° to expose the respective numerical section.

13 Claims, 4 Drawing Sheets

FIG. 3
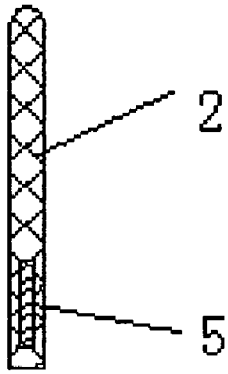
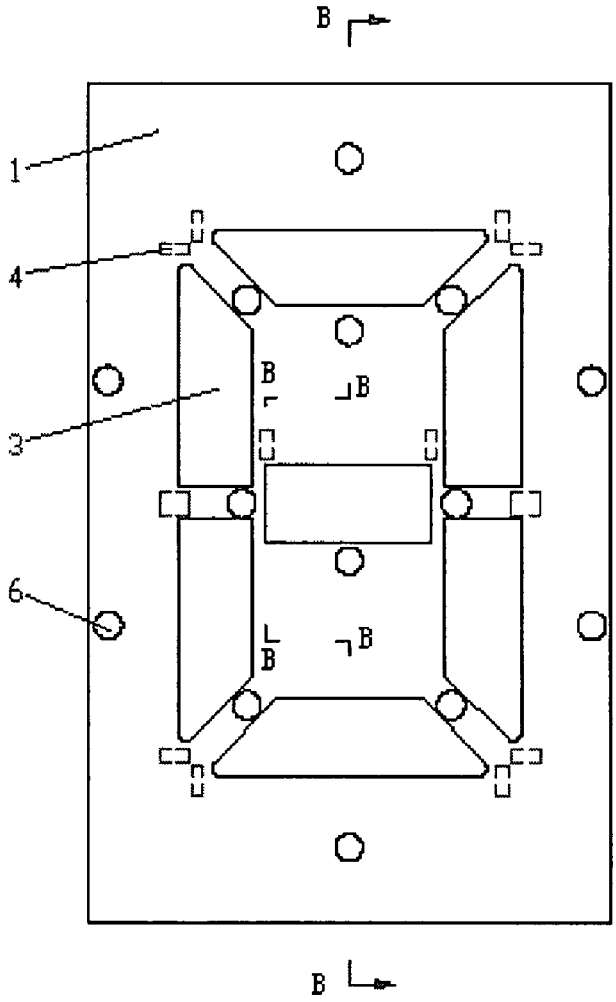
FIG. 4

NUMERICAL DISPLAY DEVICE

BACKGROUND OF THE PRESENT INVENTION

1. Field of Invention

The present invention relates to a display device, and more particularly to a numerical display device, especially for the high post advertisement board, which is adapted to selectively change each of seven numerical sections of the number character without lowering the numerical display device from the post.

2. Description of Related Arts

Generally speaking, a conventional numerical display device includes LED numerical display board, signboard with slot-in numerical panels, moving film signboard, and LCD display board. Such conventional numerical display devices, especially the LED numerical display board, moving film signboard, and LCD display board, have a common drawback that they must be connected to a power source. Thus, the cost of such numerical display devices is relatively high and the use of such numerical display devices is limited. For example, the LED numerical display board and the LCD display board cannot display the numerical character clearly under the sunlight because of the light reflection. In addition, the user must prepare enough numerical panels for selectively inserting into the signboard to display the numerical characters. When the signboard is supported at a high post, it is dangerous for the user to climb up along the post in order to change the inserting numerical panels as well.

SUMMARY OF THE PRESENT INVENTION

A main object of the present invention is to provide a numerical display device, especially for the high post advertisement board, which is adapted to selectively change each of seven numerical sections of the number character without lowering the numerical display device from the post.

Accordingly, the present invention provides a numerical display device comprising seven numerical sections provided on a base panel to form a numerical character, a plurality of folding panels pivotally coupled at the base panel via pivot hinges respectively wherein the folding panels are adapted to pivotally fold on the base panel to fully cover the numerical sections and to pivotally and outwardly folded on the base panel at 180° to expose the respective numerical sections. A plurality of first and second magnet attracting elements are embedded in the folding panels and the base panel respectively such that when the folding panels are pivotally folded on the base panel either cover or uncover the numerical sections, the first magnet attracting elements are magnetically attracted to the second magnet attracting elements to retain the folding panels in position.

Each of the numerical sections has a contrast color with respect to the base panel, wherein each of the numerical sections can be formed as a hollow cavity on the base panel, can be made of transparent material or translucent light diffusion material, or can be coated with different color from the base panel. Each of the numerical sections can also be made of light reflective material or fluorescent material. Accordingly, two covering sides of each of the folding panel are coated with the same color of the base panel. Each of the folding panels has a shape corresponding to the numerical section and has a size slightly larger than the numerical section such that each of the folding panel is pivotally folded on the base panel either to fully cover the respective numerical section or to pivotally and outwardly folded on the base panel at 180° to expose the respective numerical section, so as to selectively change the numerical character.

An operation shaft is used as a tool to fold the folding panels so as to change the numerical character. The operation shaft has an angled end portion coupling with an operation head. An operation magnet attracting element is embedded in the operation head, wherein the polarity of the operation magnet attracting element is the same as the polarity of each of the second magnet attracting elements at the base panel. The operation magnet attracting element is magnetically attracted to the first magnet attracting element when the operation head is positioned close enough to the respective folding panel. Preferably, the operation head should be contacted with the folding panel at a position that the operation magnet attracting element is not aligned with the second magnet attracting element on the base panel. In other words, the magnetic attracting force between the folding panel and the base panel is weaker than that between the folding panel and the operation head, the folding panel is pulled from the base panel. Then, by quickly applying a pulling force against the folding panel, the folding panel is pivotally folded at 180°.

For a better visual effect, the base panel can be supported by a tall supporting post, wherein a light source can be supported at the back of the base panel for generating light towards the numerical sections, especially when the numerical sections are made of light diffusion material. Accordingly, even though the numerical display device of the present invention is supported at a relatively high position via the supporting post, the operator is able to selectively change the numerical character via the operation shaft.

BRIEF DESCRIPTION OF THE DRAWINGS

FIG. 3 is a sectional view of the folding panel of the numerical display device according to the preferred embodiment of the present invention.

FIG. 4 is a schematic view of a base panel of the numerical display device according to the preferred embodiment of the present invention.

DETAILED DESCRIPTION OF THE PREFERRED EMBODIMENT

Figure 1:
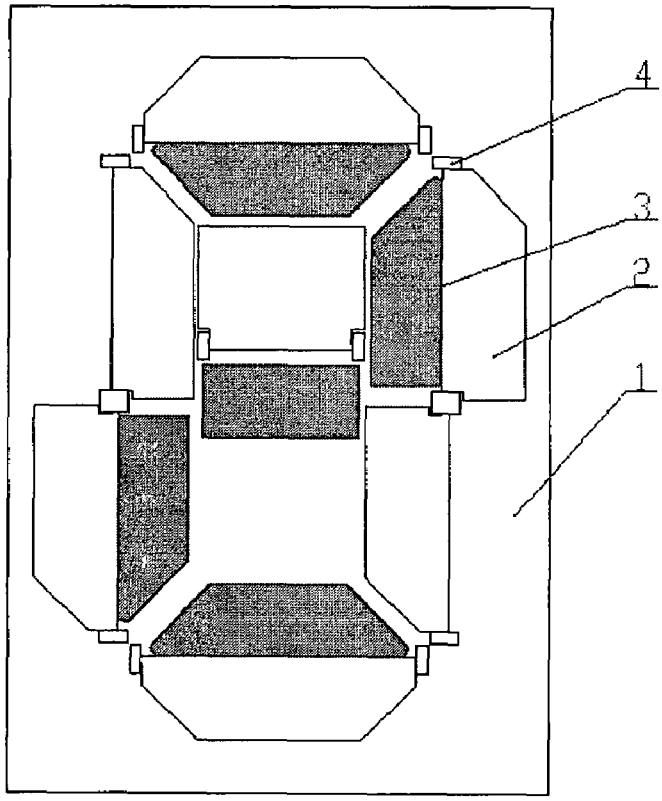
FIG. 1 is a schematic view of a numerical display device according to a preferred embodiment of the present invention.

Referring to FIG. 1 of the drawings, a numerical display device according to a preferred embodiment of the present invention is illustrated, wherein the numerical display device comprises a base panel 1, a plurality of folding panels 2, a plurality of numerical sections 3 arrayed to form at least a numerical character, a pivot hinge 4, a plurality of first magnet attracting elements 5, a plurality of second magnet attracting elements 6, an operation shaft 7, an operation head 8, and an operation magnet attracting element 9.

As shown in FIG. 1, there are seven numerical sections 3 formed on the base panel 1 to form a numerical character that the seven numerical sections 3 are adapted to selectively form the number from 0 to 9. Accordingly, a plurality of sets of numerical sections 3 are provided on the base panel 1, wherein each set contains seven numerical sections 3 to represent one numerical character. The color of each of the numerical sections 3 is contrast with the color of the base panel 1. The base panel 1 is made of light blocking material or opaque material such that the light cannot be penetrated through the base panel 1. Each of the numerical sections 3 is made of light diffusion material, transparent material, or light reflective material. Each of the numerical sections 3 can be formed on the base panel 1 by forming a hollow cavity on the base panel 1. Each of the folding panels 2, shaped corresponding to the numerical section 3, is pivotally coupled at the base panel 1 via the pivot hinge 4. Two covering sides of each of the folding panels 2 are coated with the same color of the base panel 1. Each of the folding panels 2, having a size slightly larger than a size of the numerical section 3, is adapted to pivotally fold on the base panel 1 to fully cover the respective numerical section 3 and to pivotally and outwardly fold on the base panel 1 at 180° to expose the respective numerical section 3. In other words, each of the folding panels 2 is pivotally folded between a first position to fully cover the respective numerical section 3 and a second position to expose the respective numerical section 3.

Figure 2:
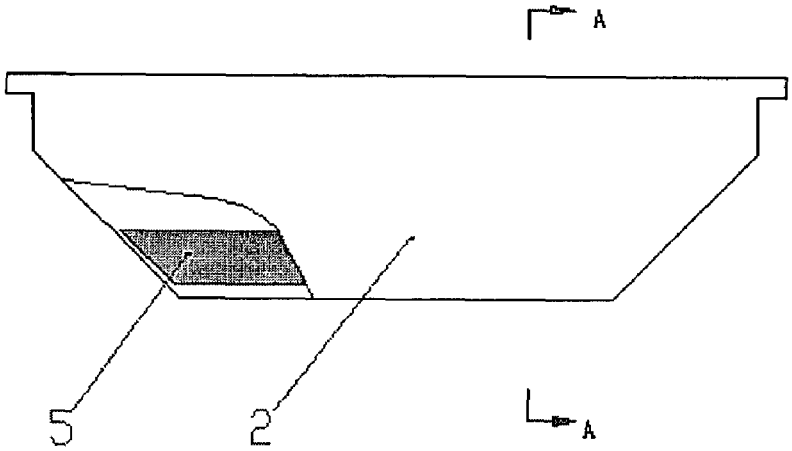
FIG. 2 is a schematic view of a folding panel of the numerical display device according to the preferred embodiment of the present invention, illustrating a magnet attracting element being embedded in the folding panel.

As shown in FIG. 2, the first magnet attracting element 5 is a thin metal strip having magnetic attraction ability, wherein the first magnet attracting element 5 is embedded into the folding panel 2 at a free edge thereof. Alternatively, the folding panel 2 can be made of material having magnetic attraction ability to omit the use of the first magnet attracting element 5. As shown in FIG. 3, the first magnet attracting element 5 is embedded into the folding panel 2 between two opposed sides thereof.

Figure 5:
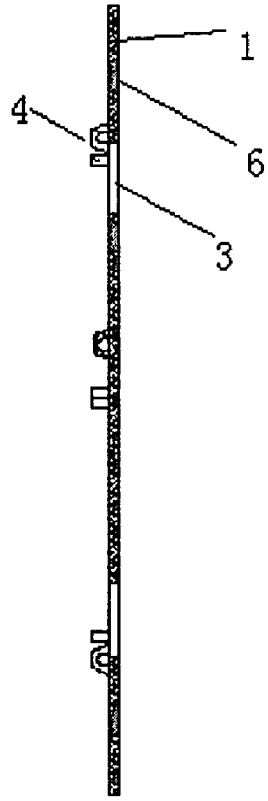
FIG. 5 is a sectional view of the base panel of the numerical display device according to the preferred embodiment of the present invention.

As shown in FIG. 4, the second magnet attracting elements 6 are spacedly provided at the base panel 1 adjacent to the numerical sections 3 respectively, wherein the second magnet attracting elements 6 are permanent magnets. Alternatively, the first and second magnet attracting elements 5, 6 can be made of permanent magnets and metal strips respectively. In particularly, the second magnet attracting elements 6 are embedded into the base panel 1. Accordingly, the second magnet attracting elements 6 are provided at predetermined positions that when the folding panel 2 is folded to cover the respective numerical section 3, the first magnet attracting element 5 at the folding panel 2 is magnetically attracted to the corresponding second magnet attracting element 6 at the base panel 1 to retain the folding panel 2 in position. Likewise, when the folding panel 2 is folded to expose the respective numerical section 3, the first magnet attracting element 5 at the folding panel 2 is magnetically attracted to the corresponding second magnet attracting element 6 at the base panel 1 to retain the folding panel 2 in position. FIG. 5 illustrates the structural configurations the pivot hinge 4 and the second magnet attracting element 6 with respect to the base panel 1. It is worth to mention that the first and second magnet attracting elements 5, 6 and the operation magnet attracting element 9 can be permanent magnets and/or metal strips correspondingly for operation.

Figure 6:
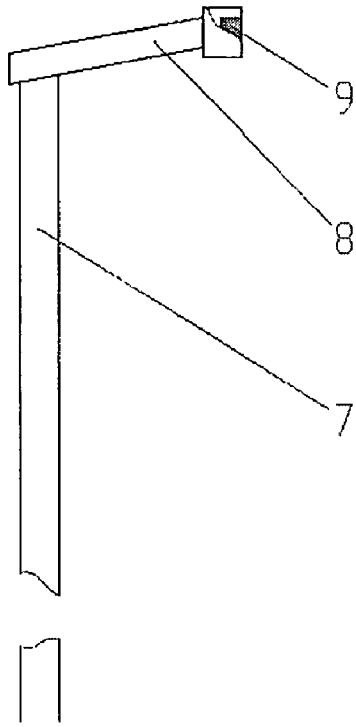
FIG. 6 illustrates an operation shaft of the numerical display device according to the preferred embodiment of the present invention.

As shown in FIG. 6, the operation head 8 is provided at the end of the operation shaft 7 wherein the operation magnet attracting element 9 provided at the operation head 8. Accordingly, the operation magnet attracting element 9 is embedded in the operation head 8, wherein the operation magnet attracting element 9 is adapted to magnetically attract to the first magnet attracting element 5 at each of the folding panels 2. In addition, the polarity of the operation magnet attracting element 9 is the same as the polarity of each of the second magnet attracting elements 6 at the base panel 1. Thus, the operation magnet attracting element 9 has a magnetically attraction ability stronger than each of the second magnet attracting elements 6 such that the operation magnet attracting element 9 has a magnetic attracting force larger than a magnetically attracting force of each of the second magnet attracting element 6. Therefore, the folding panel 2 is adapted to be pivotally folded by the operation shaft 8 via the operation magnet attracting element 9 when the folding panel 2 is magnetically attracted to the second magnet attracting element 6 at the base panel 1.

Figure 7:
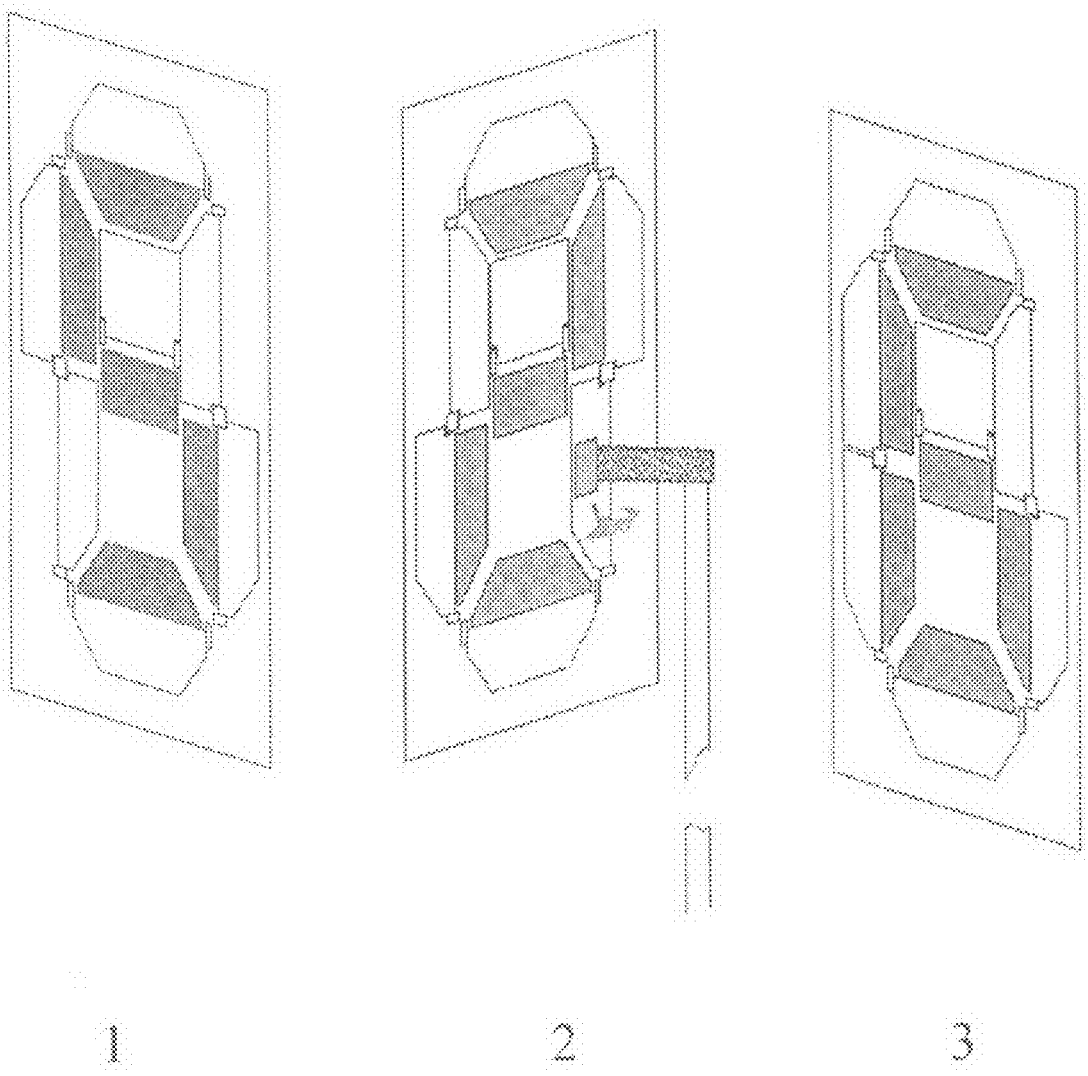
FIG. 7 illustrates an operation of the numerical display device according to the preferred embodiment of the present invention.

FIG. 7 illustrates the operation of the present invention. As shown in FIG. 7-1, some of the folding panels 2 are folded to cover the numerical sections 3 while some of the folding panels 2 are folded to expose the numerical sections 3 such that the uncovered numerical sections 3 form a numerical character. In order to change the numerical character, the user is able to extend the operation shaft 7 until the operation head 8 reaches the desired folding panel 2. The operation magnet attracting element 9 at the operation head 8 is then magnetically attracted to the first magnet attracting element 5 at the desired folding panel 2 such that the desired folding panel 2 will be magnetically attracted to the operation head 8, as shown in FIG. 7-2. By applying a pulling force, the desired folding panel 2 will be automatically and pivotally folded to disengage the first magnet attracting element 5 at the desired folding panel 2 with the corresponding second magnet attracting element 6. By quickly folding the desired folding panel 2 at 180°, the first magnet attracting element 5 at the desired folding panel 2 will magnetically attract to another corresponding second magnet attracting element 6 such that the folding panel 2 is pivotally folded at 180°. Therefore, the numerical character can be changed by selectively folding the folding panel 2 as shown in FIG. 7-3.

What is claimed is:

1. A numerical display device, comprising:

a base panel;

at least a set of numerical sections, wherein each set contains seven numerical sections provided on said base panel to form a numerical character;

a plurality of folding panels pivotally coupling at said base panel to fold between a first position and a second position to selectively change said numerical character, wherein at said first position, said folding panel is pivotally folded on said base panel to fully cover said respective numerical section, and at said second position, said folding panel is pivotally folded at 180° to expose said respective numerical section; and means for retaining each of said folding panels at said first and second positions, wherein said retaining means comprises a plurality of first magnet attracting elements provided at said folding panels respectively and a plurality of second magnet attracting elements spacedly provided at said base panel adjacent to said numerical sections respectively, wherein said first magnet attracting elements are magnetically attracted to said second magnetic elements respectively to retain said folding panels between said first and second positions, wherein each of said first magnet attracting elements is a thin metal strip having magnetic attraction ability and is embedded in said respective folding panel, wherein said second magnet attracting elements are permanent magnets embedded into said base panel.

2. The numerical display device, as recited in claim 1, wherein each of said folding panels has a shape corresponding to a shape of said numerical section and has a size slightly larger than a size of said numerical section to fully cover said respective numerical section at said first position.

3. The numerical display device, as recited in claim 1, wherein each of said numerical sections has a contrast color to said base panel.

4. The numerical display device, as recited in claim 2, wherein each of said numerical sections has a contrast color to said base panel.

5. The numerical display device, as recited in claim 2, wherein two covering sides of each of said folding panel are coated with the same color of said base panel.

6. The numerical display device, as recited in claim 4, wherein two covering sides of each of said folding panel are coated with the same color of said base panel.

7. The numerical display device, as recited in claim 4, further comprising an operation shaft having an angled end portion, an operation head coupling at said angled end portion of said operation shaft, and an operation magnet attracting element embedded in said operation head to magnetically attract to said first magnet attracting element.

8. The numerical display device, as recited in claim 6, further comprising an operation shaft having an angled end portion, an operation head coupling at said angled end portion of said operation shaft, and an operation magnet attracting element embedded in said operation head to magnetically attract to said first magnet attracting element.

9. The numerical display device, as recited in claim 7, wherein a polarity of said operation magnet attracting element is the same as a polarity of each of said second magnet attracting elements at said base panel.

10. The numerical display device, as recited in claim 8, wherein a polarity of said operation magnet attracting element is the same as a polarity of each of said second magnet attracting elements at said base panel.

11. The numerical display device, as recited in claim 8, wherein said numerical sections are made of material selected from the group consisting of transparent material, translucent light diffusion material, light reflective material and fluorescent material.

12. The numerical display device, as recited in claim 10, wherein said numerical sections are made of material selected from the group consisting of transparent material, translucent light diffusion material, light reflective material and fluorescent material.

13. A numerical display device, comprising:

a base panel;

at least a set of numerical sections, wherein each set contains seven numerical sections provided on said base panel to form a numerical character;

a plurality of folding panels pivotally coupling at said base panel to fold between a first position and a second position to selectively change said numerical character, wherein at said first position, said folding panel is pivotally folded on said base panel to fully cover said respective numerical section, and at said second position, said folding panel is pivotally folded at 180° to expose said respective numerical section;

means for retaining each of said folding panels at said first and second positions, wherein said retaining means comprises a plurality of first magnet attracting elements provided at said folding panels respectively and a plurality of second magnet attracting elements spacedly provided at said base panel adjacent to said numerical sections respectively, wherein said first magnet attracting elements are magnetically attracted to said second magnetic elements respectively to retain said folding panels between said first and second positions; and an operation shaft having an angled end portion, an operation head coupling at said angled end portion of said operation shaft, and an operation magnet attracting element embedded in said operation head to magnetically attract to said first magnet attracting element, wherein a polarity of said operation magnet attracting element is the same as a polarity of each of said second magnet attracting elements at said base panel.

* * * * *